US007126562B1

(12) United States Patent
Irie et al.

(10) Patent No.: US 7,126,562 B1
(45) Date of Patent: Oct. 24, 2006

(54) PLASMA DISPLAY PANEL WITH CONSTANT COLOR TEMPERATURE OR COLOR DEVIATION

(75) Inventors: Katsuya Irie, Kawasaki (JP); Fumihiro Namiki, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 163 days.

(21) Appl. No.: 09/593,424

(22) Filed: Jun. 14, 2000

(30) Foreign Application Priority Data

Jun. 30, 1999 (JP) ..... 11-186818

(51) Int. Cl.
*G09G 3/28* (2006.01)

(52) U.S. Cl. ..... 345/63; 345/60; 345/68

(58) Field of Classification Search ..... 345/60–100, 345/600; 315/169.1, 169.4; 313/582
See application file for complete search history.

(56) References Cited

U.S. PATENT DOCUMENTS 4,692,665 A * 9/1987 Sakuma ..... 315/169.4
5,045,846 A 9/1991 Gay et al.
5,526,058 A 6/1996 Sano et al.
5,541,618 A * 7/1996 Shinoda ..... 345/60
5,546,101 A * 8/1996 Sugawara ..... 345/63
5,757,343 A * 5/1998 Nagakubo ..... 345/63
6,034,655 A * 3/2000 You ..... 345/60
6,034,656 A * 3/2000 Yamamoto et al. ..... 345/60
6,052,101 A * 4/2000 Moon ..... 345/60
6,061,040 A * 5/2000 Onodera et al. ..... 345/67
6,100,859 A * 8/2000 Kuriyama et al. ..... 345/60
6,115,011 A * 9/2000 Sano et al. ..... 345/64
6,249,268 B1 * 6/2001 Tachibana et al. ..... 345/87
6,331,843 B1 * 12/2001 Kasahara et al. ..... 345/63
6,344,839 B1 * 2/2002 Denda et al. ..... 345/60
6,348,762 B1 * 2/2002 Nunomura et al. ..... 313/582
6,351,253 B1 * 2/2002 Kasahara et al. ..... 345/63
6,353,292 B1 * 3/2002 Takamori et al. ..... 315/169.4
6,356,017 B1 * 3/2002 Makino ..... 345/60
6,400,347 B1 * 6/2002 Kang ..... 345/68
6,424,325 B1 * 7/2002 Van Dijk ..... 345/60

(Continued)

FOREIGN PATENT DOCUMENTS

EP 0 614 321 A2 9/1994

(Continued)

OTHER PUBLICATIONS

English translation of Japanese Patent document 9-281927, dated Oct. 31, 1997, the Japanese Patent document was submitted in a previously filed IDS filed on Dec. 29, 2003.

*Primary Examiner*—Bipin Shalwala
*Assistant Examiner*—David L. Lewis
(74) *Attorney, Agent, or Firm*—Staas & Halsey LLP

(57) ABSTRACT

The present invention is characterized in that the PDP drive means makes correction so as to decrease the emission intensity of green or to increase the emission intensity of blue as the display load factor increases compared with the case when the display load factor is lower. Or, the PDP drive means makes correction so as to increase the emission intensity of green or to decrease the emission intensity of blue as the display load factor decreases compared with the case when the display load factor is higher. Such a correction is effective when the monochromatic emission luminance of the fluorescent substance has such a saturation characteristic that the decrease in green is greater than blue as the emission frequency increases. Therefore, when the saturation characteristic is the opposite in terms of the relationship between green and blue, the increase/decrease of the emission intensity in the above correction must be the opposite.

16 Claims, 10 Drawing Sheets

Display Load Factor, Drive Frequency and Color Temperature Characteristics

| Case | Display Load Factor | Driving Frequency | Power Consumption | Relative composing ratio of each color in white | | | Embodiment(Correction) | | |
|---|---|---|---|---|---|---|---|---|---|
| | | | | Red | Green | Blue | Red | Green | Blue |
| A | Low | High | Small | Middle | Weaker | Stronger | – | Increased | Decreased |
| B | High | Low | Large | Middle | Stronger | Weaker | – | Decreased | Increased |

U.S. PATENT DOCUMENTS

| | | | | |
|---|---|---|---|---|
| 6,724,356 | B1 * | 4/2004 | Kojima et al. | 345/60 |
| 2002/0008679 | A1 * | 1/2002 | Rutherford | 345/60 |
| 2002/0033830 | A1 * | 3/2002 | Yamakawa | 345/600 |
| 2002/0044105 | A1 * | 4/2002 | Nagai | 345/60 |

FOREIGN PATENT DOCUMENTS

| | | | |
|---|---|---|---|
| EP | 0 653 740 | A2 | 5/1995 |
| EP | 0 924 683 | A2 | 6/1999 |
| JP | 5-61437 | | 12/1993 |
| JP | 8-9415 | | 12/1996 |
| JP | 09-244574 | | 9/1997 |
| JP | 9-281927 | | 10/1997 |
| JP | 9-319331 | | 12/1997 |

* cited by examiner

FIG. 5

Display Load Factor, Drive Frequency and Color Temperature Characteristics

| Case | Display Load Factor | Driving Frequency | Power Consumption | Relative composing ratio of each color in white | | | Embodiment(Correction) | | |
|---|---|---|---|---|---|---|---|---|---|
| | | | | Red | Green | Blue | Red | Green | Blue |
| A | Low | High | Small | Middle | Weaker | Stronger | – | Increased | Decreased |
| B | High | Low | Large | Middle | Stronger | Weaker | – | Decreased | Increased |

PLASMA DISPLAY PANEL WITH CONSTANT COLOR TEMPERATURE OR COLOR DEVIATION

BACKGROUND OF THE INVENTION

1. Field of the Invention

The present invention relates to a plasma display panel (hereafter PDP), and more particularly to a PDP which can keep color temperature or color deviation constant regardless the display load factor.

2. Description of the Related Art

PDP is a flat display panel which implements a 42 inch large screen. PDP has a gas discharge space where discharge gas is sealed between the front face side substrate and the rear face side substrate. By ultra-violet rays generated by the space charges, ions and electrons, which are generated by discharging in the gas discharge space, fluorescent substances formed inside are excited and the desired color display is implemented. Generally fluorescent substances for three primary colors, red (R), green (G) and blue (B) are formed in each pixel, and the color display based on the combination of the three primary colors is executed by controlling the each emission intensity in each pixel.

In this case, if the grayscale of RGB is 256, for example, a black display is executed when all the grayscales of RGB are 0, and the white display is executed when all the grayscales of RGB are 256. When the grayscales of RGB are less than 256 but are all equal, the white display with low luminance (gray) is executed.

FIG. 1 is a curve of color temperature. The abscissa is the x chromaticity coordinate, and the ordinate is the y chromaticity coordinate. The curve with 0 deviation is a black body radiation curve where the color temperature changes along the curve. Along this black body radiation curve, a bluish white is generated if the color temperature is high, and yellowish white is generated if the color temperature is low. Also, at each color temperature, a greenish white is generated if deviation shifts to the positive direction and reddish white is generated if deviation shifts to the negative direction.

For the color temperature of white created by three primary colors, it is generally said that 9000–10000K is the optimum for Japanese. And it is said that 6000K is the optimum for Europeans and Americans. White for PDP is desirable to be set to the above optimum color temperature values.

FIG. 2 are drawings depicting the relationship between the display load factor, color temperature value and color temperature deviation of a general PDP. FIG. 2A shows the relationship between the display load factor and the color temperature value of white to be displayed for three types of PDPs, and FIG. 2B shows the relationship between the display load factor and the color temperature deviation of white to be displayed for the same three types of PDPs. The display load factor is a ratio of the display load which depends on luminance and/or display area of a display image, where (1) when 256 grayscales, which is the maximum grayscale, of white is displayed on the entire display screen, and the display load factor is 100%, (2) the display load factor decreases as the ratio of white to black in the display screen decreases, and (3) the display load factor decreases as the grayscale value of white decreases even if the ratio of the white to black is the same.

As FIG. 2A shows, in the case of a PDP made by company B, for example, the color temperature value when the display load factor is 30% is 10000K, where roughly an optimum white is displayed, but as the display load factor increases, the color temperature value of white decreases and white becomes yellowish. This tendency is the same for the PDPs made by company A and company C.

As FIG. 2B shows, in the case of company A and company C, the deviation of the color temperature is almost 0 when the display load factor is about 30%, but as the display load factor increases, the deviation changes to the positive side and white becomes greenish.

It is a serious problem where white turns a color in this manner depending on the display load factor.

SUMMARY OF THE INVENTION

It is accordingly an object of the present invention to provide a PDP where the chromaticity coordinates of white do not fluctuate depending on the display load factor.

It is another object of the present invention to provide a PDP where the color temperature of white does not fluctuate depending on the display load factor.

It is still another object of the present invention to provide a PDP where the deviation of the chromaticity coordinate values of white on the black body radiation curve do not fluctuate even if the display load factor changes.

To achieve the above objects, one aspect of the present invention is characterized in that the PDP drive means makes correction so as to decrease the emission intensity of green or to increase the emission intensity of blue as the display load factor increases compared with the case when the display load factor is lower. Or, the PDP drive means makes correction so as to increase the emission intensity of green or to decrease the emission intensity of blue as the display load factor decreases compared with the case when the display load factor is higher. Such a correction is effective when the monochromatic emission luminance of the fluorescent substance has such a saturation characteristic that the decrease in green is greater than blue as the emission frequency increases. Therefore, when the saturation characteristic is the opposite in terms of the relationship between green and blue, the increase/decrease of the emission intensity in the above correction must be the opposite.

There are various ways to detect the display load factor. In a preferred embodiment, for example, the power consumption of the panel is monitored, and if the power consumption increases, display is corrected such that the emission intensity of green is decreased or the emission intensity of blue is increased. If power consumption decreases, on the other hand, display is corrected such that the emission intensity of green is increased or the emission intensity of blue is increased.

In the case of another preferred embodiment, the drive frequency of the sustain discharge pulse is monitored and if the drive frequency decreases, display is corrected such that the emission intensity of green is decreased or the emission intensity of blue is increased. If the drive frequency increases, on the other hand, display is corrected such that the emission intensity of green is increased or the emission intensity of blue is decreased.

As the above mentioned correction method for increasing or decreasing the emission intensity, increasing or decreasing the signal intensity of green and blue to be supplied is preferable. Because of this, the signal intensity of green for white, for example, is corrected to be lower as the display load factor increases so that white, which is the same as when the display load factor is lower, is displayed.

The above invention prevents the optimum chromaticity coordinate values from deviating by the fluctuation of the color temperature value or by the deviation of the color temperature of white to be displayed along with the fluctuation of the display load factor.

To achieve the above objects, another aspect of the present invention is characterized in that the PDP drive means controls the drive frequency of the sustain discharge pulse so as to be limited in the range where the emission intensity of the fluorescent substances of the panel does not saturate. In this case, when the emission intensity of the fluorescent substances of RGB of the panel have different saturation characteristics as the drive frequency increases, the drive means does not use the drive frequency which reaches the saturation area. Therefore, influence by the emission intensity saturation characteristic of the fluorescent substances of RGB is eliminated, the color temperature value or the deviation of the color temperature of white to be displayed is kept roughly constant without depending on the display load factor, and deviation from the optimum chromaticity coordinate values is prevented.

To achieve the above objects, the present invention is a plasma display panel which displays colors by exciting a plurality of fluorescent substances using ultra-violet rays generated during discharge, wherein depending on a change of the display load factor, the plasma display panel drive unit corrects display by changing the emission intensity of a fluorescent substance of a predetermined color so that the ratio of the emission intensity of the above fluorescent substance of each color during white display is roughly the same when the above display load factor is low and high.

It is still another object of the present invention to provide a PDP where white does not turn color depending on the display load factor by maintaining the chromaticity coordinate values during white display within ±0.005uv of the deviation area from the color temperature curve denoted by the black body radiation curve, regardless the display load which depends on the luminance of the display image or display area.

BRIEF DESCRIPTION OF THE DRAWINGS

FIG. 5 is a table showing the display load factor, drive frequency and color temperature characteristics;

DESCRIPTION OF THE PREFERRED EMBODIMENTS

Embodiments of the present invention will now be described with reference to the accompanying drawings. These embodiments, however, do not restrict the technical scope of the present invention.

Figure 3:
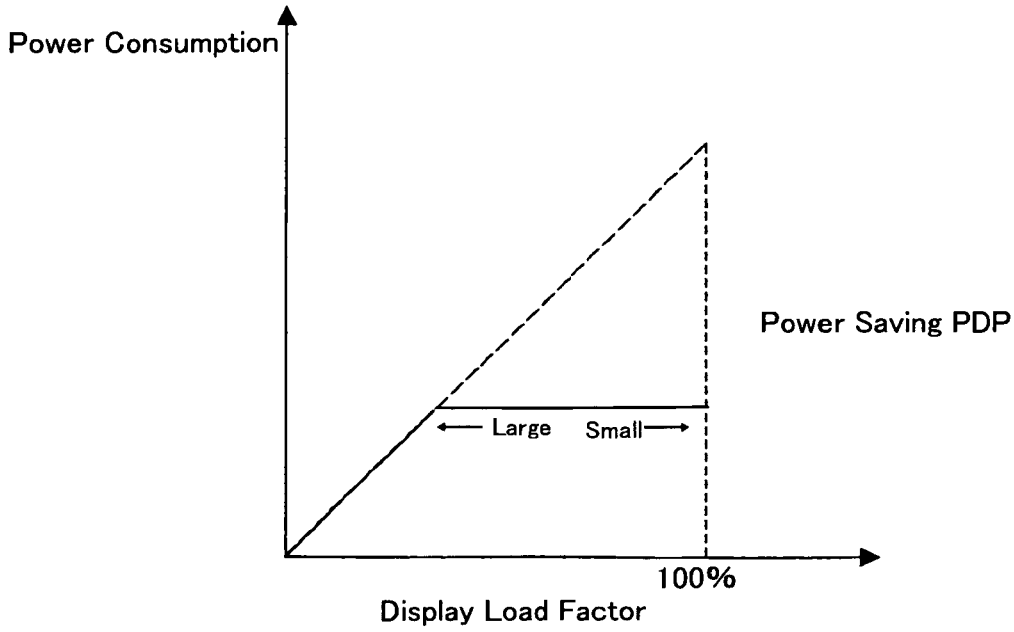
FIG. 3 is a drawing depicting the relationship between the display load factor, power consumption and drive frequency of a PDP.

FIG. 3 is a drawing depicting the relationship between the display load factor, power consumption and drive frequency of a PDP. As the display load factor increases, that is, as the display area increases and the display luminance of white increases, the required number of times of emissions during the sustain discharge increases and the power consumption of the panel increases. In a normal PDP, however, an increase in power consumption is not desirable and the drive circuit limits the drive frequency during the sustain discharge so that the power consumption is clamped to a predetermined value even if the display load factor increases. In other words, when the display load factor further increases after the predetermined display load factor is exceeded, as shown in FIG. 3, the drive circuit controls to decrease the drive frequency so that the power consumption is clamped to a predetermined value.

Figure 4:
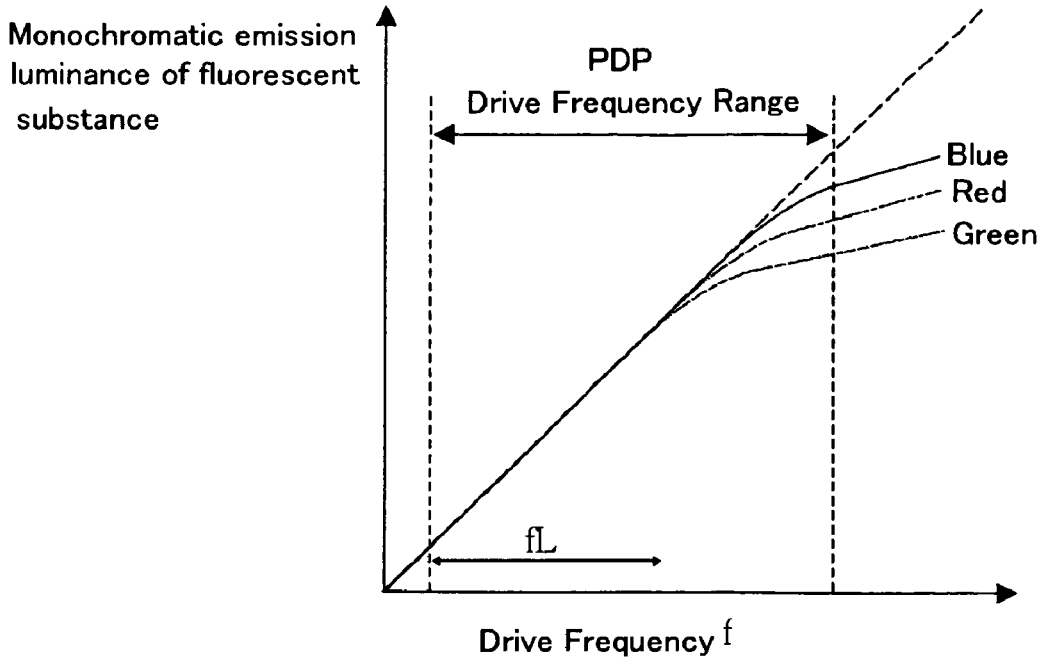
FIG. 4 is a drawing depicting the relationship between the drive frequency f and the monochromatic emission luminance of the fluorescent substances of a PDP.

FIG. 4 is a drawing depicting the relationship between the drive frequency f and the monochromatic emission luminance of the fluorescent substances of the PDP. The monochromatic emission luminance of a fluorescent substance which can be used for PDP is generally low in the area where the drive frequency is low, and the monochromatic emission luminance increases as the drive frequency increases and the number of times of emission increases. However, as FIG. 4 shows, the emission luminance of the fluorescent substance of each RGB color reaches the saturation area when the drive frequency is further increased. Also, in the saturation characteristics of the fluorescent substances of RGB, the emission luminance of the green fluorescent substance drops considerably and the emission luminance of the blue fluorescent substance does not drop very much. Such saturation characteristics are unique to fluorescent substances, and at the moment almost all available fluorescent substances have such saturation characteristics.

Figure 1:
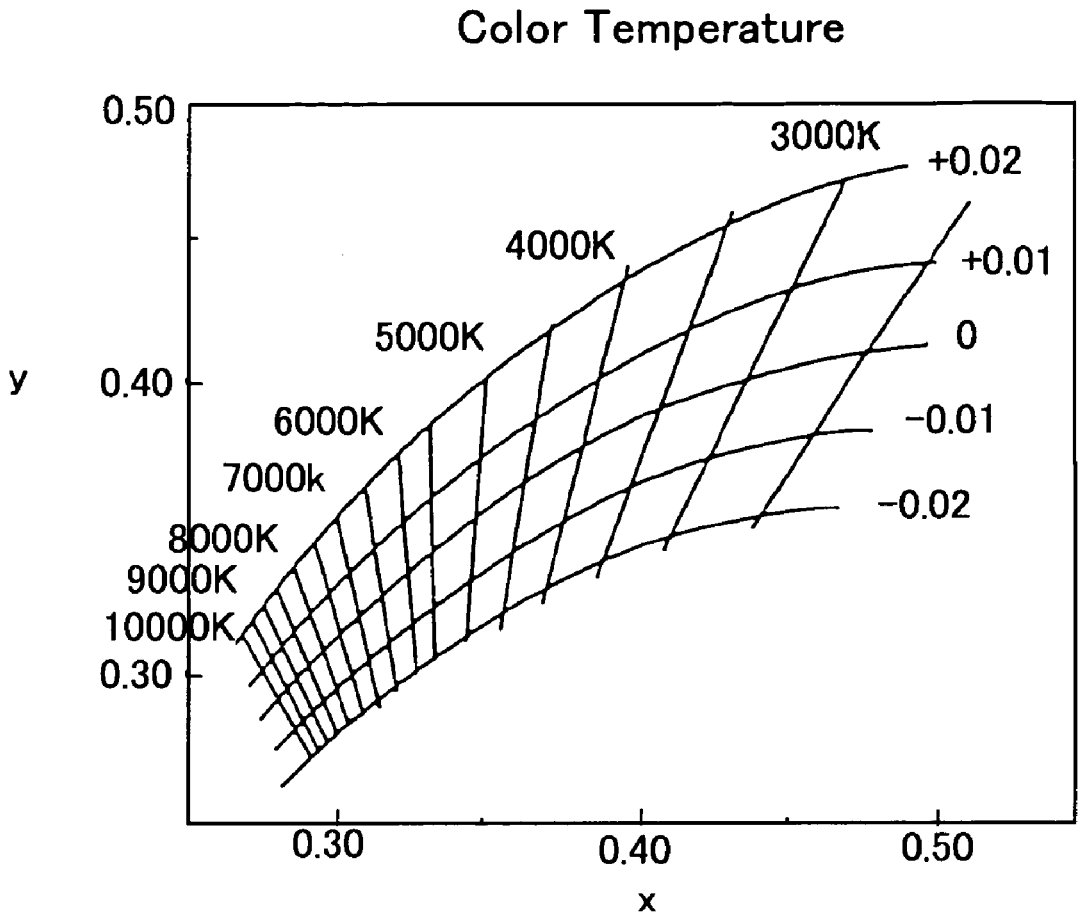
FIG. 1 is a drawing depicting the color temperature curve.
Figure 2A:
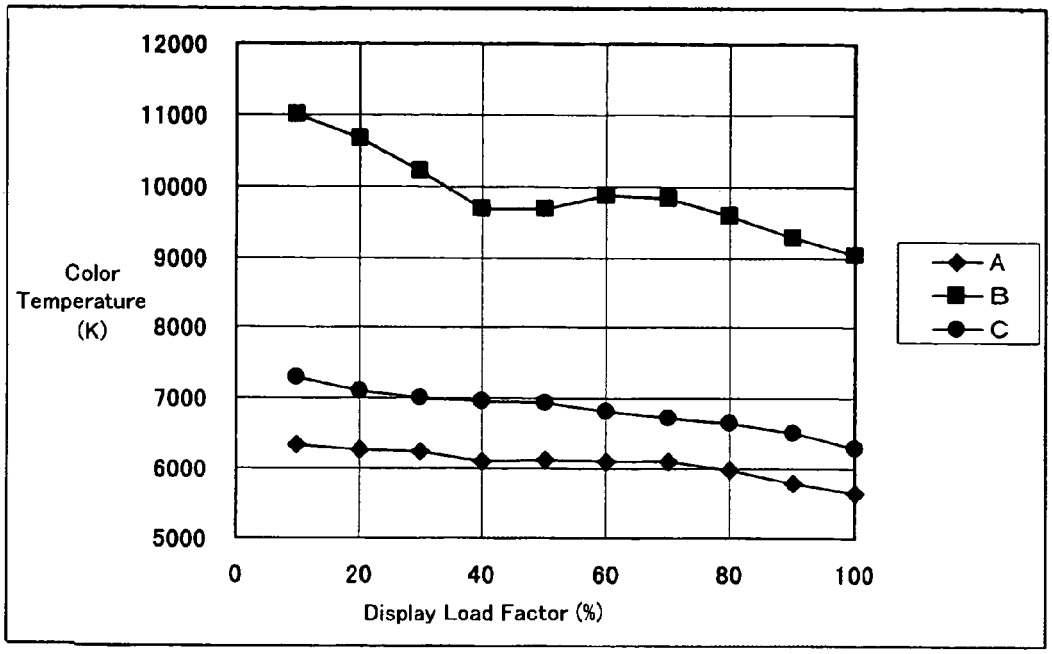
FIG. 2 are drawings depicting the relationship between the display load factor, color temperature value and color temperature deviation of a general PDP.
Figure 2B:
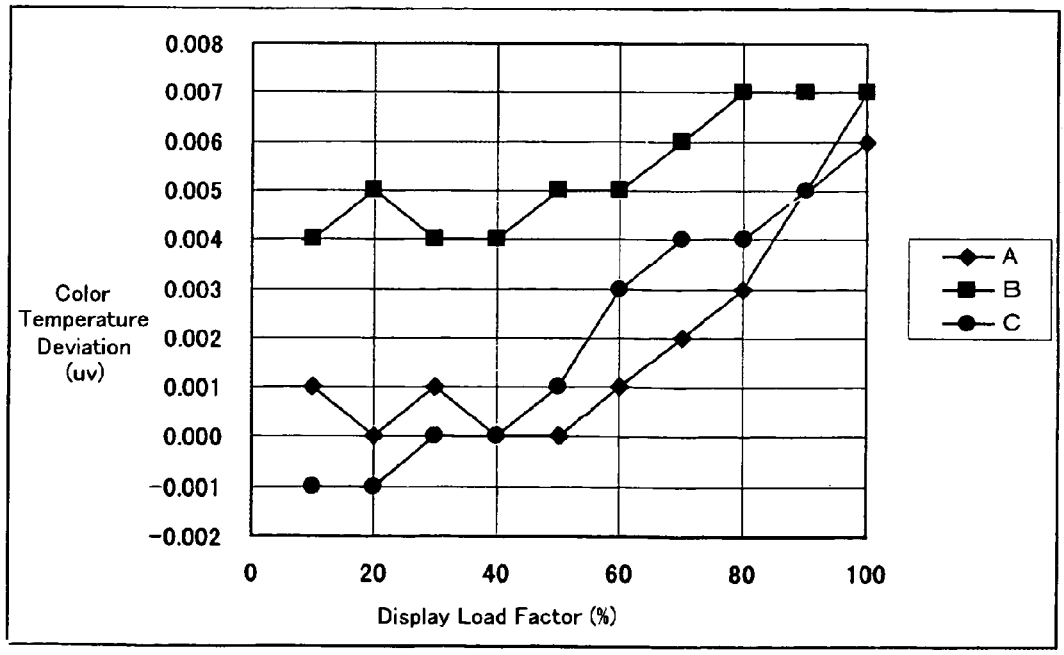

The drive method shown in FIG. 3 and the saturation characteristic of the fluorescent substance in FIG. 4 seem to be some of the reasons for the chromaticity coordinate values of white shown in FIG. 2 to fluctuate. FIG. 5 is a table showing the display load factor, drive frequency and color temperature characteristics according to the phenomena shown in FIG. 3 and FIG. 4. Case A is the case when the display load factor is small and case B is the case when the display load factor is large.

Comparing case A, where the display load factor is small, and case B, where the display load factor is large, the drive frequency is high in case A and low in case B, and power consumption decreases in case A and increases in case B, as FIG. 3 shows. Also as FIG. 4 shows, the emission intensity of green is stronger and the emission intensity of blue is weaker in case B, where the display load factor is high, compared with case A, where the display load factor is low, due to the saturation characteristics of the fluorescent substances.

Therefore, when the relative composing ratio of each color in white is set to the optimum in the area where the display load factor is low, for example, correction is made such that the emission intensity of green is decreased in case B, where the display load factor is high, more so than case A, where the display load factor is low. Or, correction is made such that the emission intensity of blue is increased in case B, where the display load factor is high, more so than case A, where the display load factor is low. Or, green and blue are simultaneously corrected.

When the relative composing ratio of each color in white is set to an optimum in the area where the display load factor is high, on the other hand, correction is made such that the emission intensity of green is increased in case A, where the display load factor is small, more so than case B, where the display load factor is high. Or, correction is made such that the emission intensity of blue is decreased in case A, where the display load factor is low, more so than case B, where the display load factor is high. Or, green and blue are simultaneously corrected.

Figure 6:
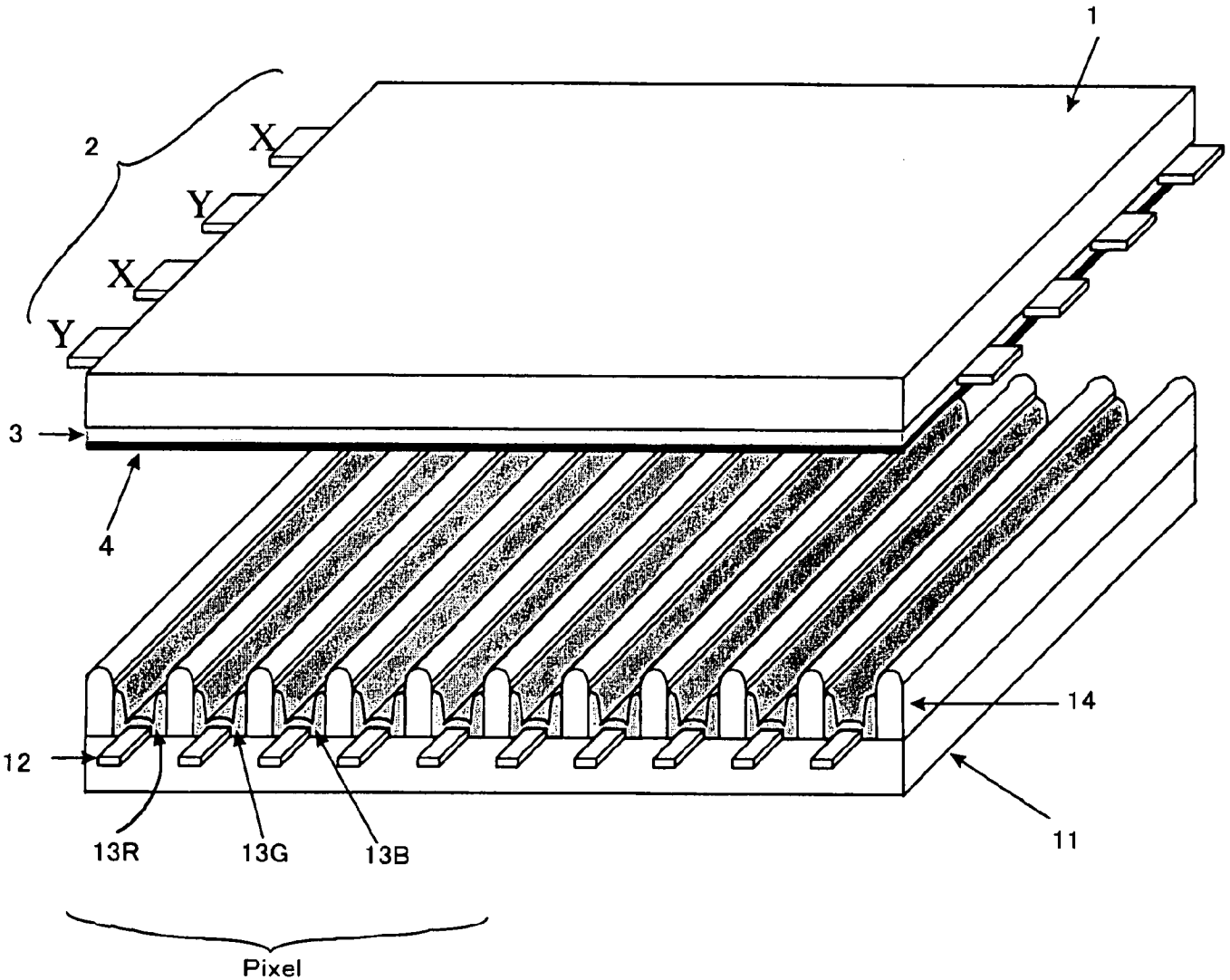
FIG. 6 is a drawing depicting a panel configuration of the PDP to which the present embodiment is applied.

FIG. 6 is a drawing depicting a panel configuration of the PDP to which the present invention is applied. The front face side substrate 1 is a transparent substrate and is comprised of a glass substrate 1, for example. On the front face side glass substrate 1, an X electrode and a Y electrode are alternately disposed as the sustain electrode 2, where the X electrode and the Y electrode form a display electrode pair. A protective layer 3 which consists of a dielectric layer and MgO is formed on the sustain electrode 2. The rear face side substrate 11 is comprised of a glass substrate, for example, where a plurality of address electrodes 12, a dielectric layer, which is not illustrated, fluorescent substances 13R, 13G and 13B for the three primary colors red (R), green (G) and blue (B), and ribs 14 are disposed in the orthogonal direction to the sustain electrode 2. A rib 14 is formed between the address electrodes 12. A discharge gas, which is not illustrated, is filled between the substrates.

Each pixel has fluorescent substances 13R, 13G and 13B for RGB respectively, and a desired color is displayed by the combination of the emission intensity of the three primary colors. When the emission intensity of the three primary colors are all at a maximum, for example, white, which has the maximum grayscales, is reproduced, and when the emission intensity of the three primary colors are all zero, black is reproduced.

Figure 7:
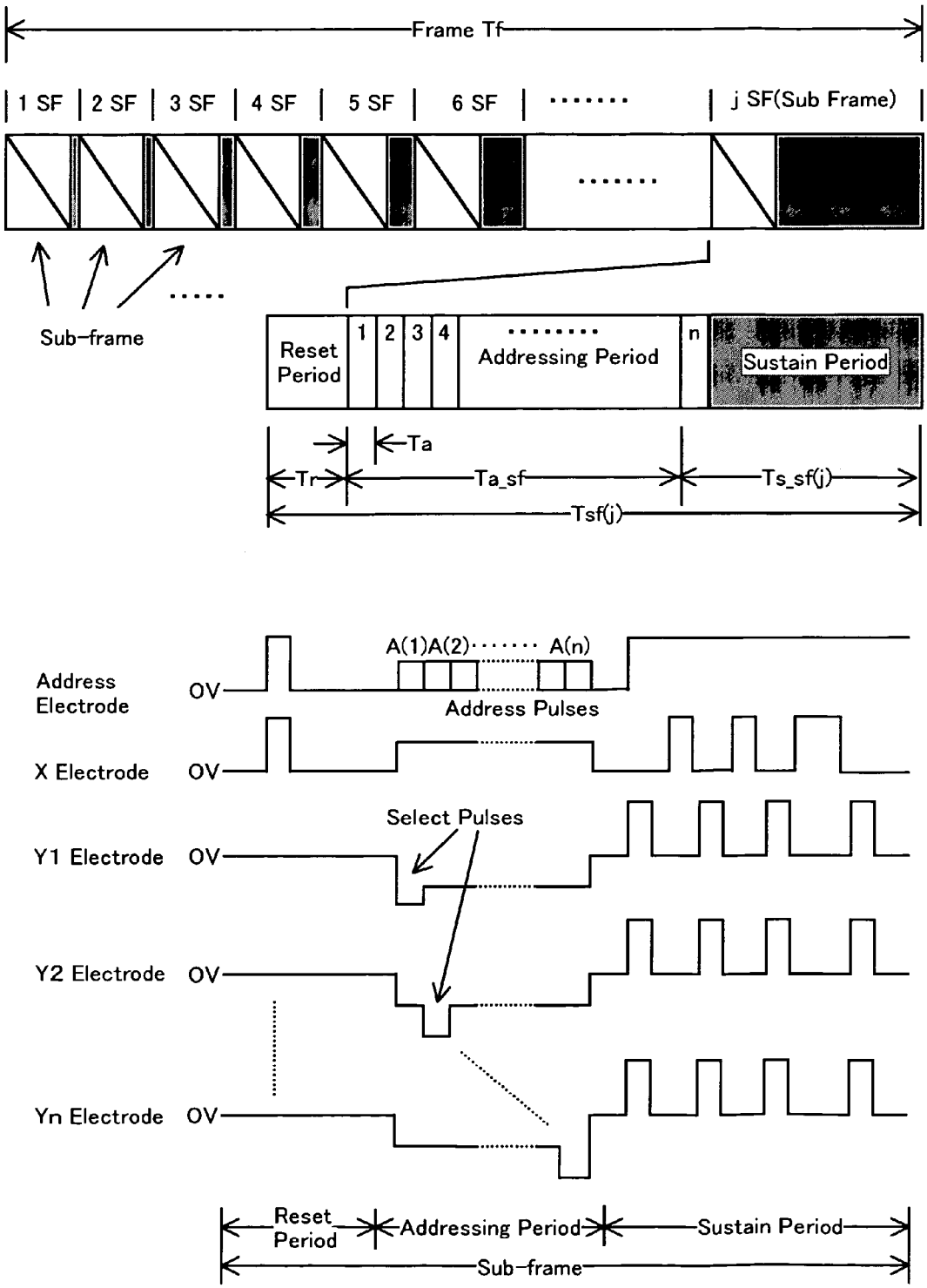
FIG. 7 is a drawing depicting an example of the drive pulse waveform of the PDP shown in FIG. 6.

FIG. 7 is a drawing depicting an example of the drive waveform pulse of the PDP shown in FIG. 6. FIG. 7 shows a drive waveform pulse in one sub-frame. Each one of the address electrodes A1, A2, . . . Am is connected to the address driver, and the address pulses A (1), A (2), . . . A (n) are applied during the addressing period Ta according to the display data. The Y electrodes Y1, Y2, . . . Yn are connected to the Y scan driver, and a selection pulse is applied from the Y scan driver during address scanning, and a sustain discharge pulse is applied from the Y common driver during emission (sustain period). The X electrodes are all connected to the X common driver from which a pulse is applied. These driver circuits are controlled by the control circuit and are controlled based on the synchronization signals and input signals, including data from the outside.

The grayscale of the plasma display panel is displayed by matching each bit of the display data to the sub-frame period and changing the length of the sustain discharge period in the sub-frame according to the weighting of the bit. For example, a when $2^j$ grayscale display is executed with j bits, one frame is divided into j number of sub-frames. The length of the sustain discharge period Ts sf(j) of each sub-frame is in the ratio of 1:2:4:8: . . . $2^{j-1}$. Here, the address period Ta sf and the reset period Tr are the same lengths for all the sub-frames.

One sub-frame period consists of the reset period Tr, address period Ta, and the sustain discharge period Ts (Ts sf). In the reset period Tr, all the Y electrodes are set to 0V, pulses are applied to all the address electrodes and X electrodes respectively, and after all the cells discharge, a self-erasing discharge for self neutralization and for ending the discharge is executed. Then, in the addressing period Ta, address selection and discharge are executed for each line to turn the cells on/off according to the display data, and the priming charge is stored. Then pulses are applied alternately to the X electrodes and Y electrodes for the sustain discharge during the sustain discharge period Ts, and an image for one sub-frame is displayed. The luminance is determined by the number of times of pulses during the sustain discharge period.

In this way, the luminance of 0 to $2^{j-1}$ grayscales can be displayed by turning on the sub-frames from 1 to j selectively.

Increasing the drive frequency of the sustain discharge pulse in the sustain discharge period Ts increases the general number of times of emissions, and increases the luminance. Increasing the drive frequency, however, tends to increase the power consumption of the panel.

Figure 8:
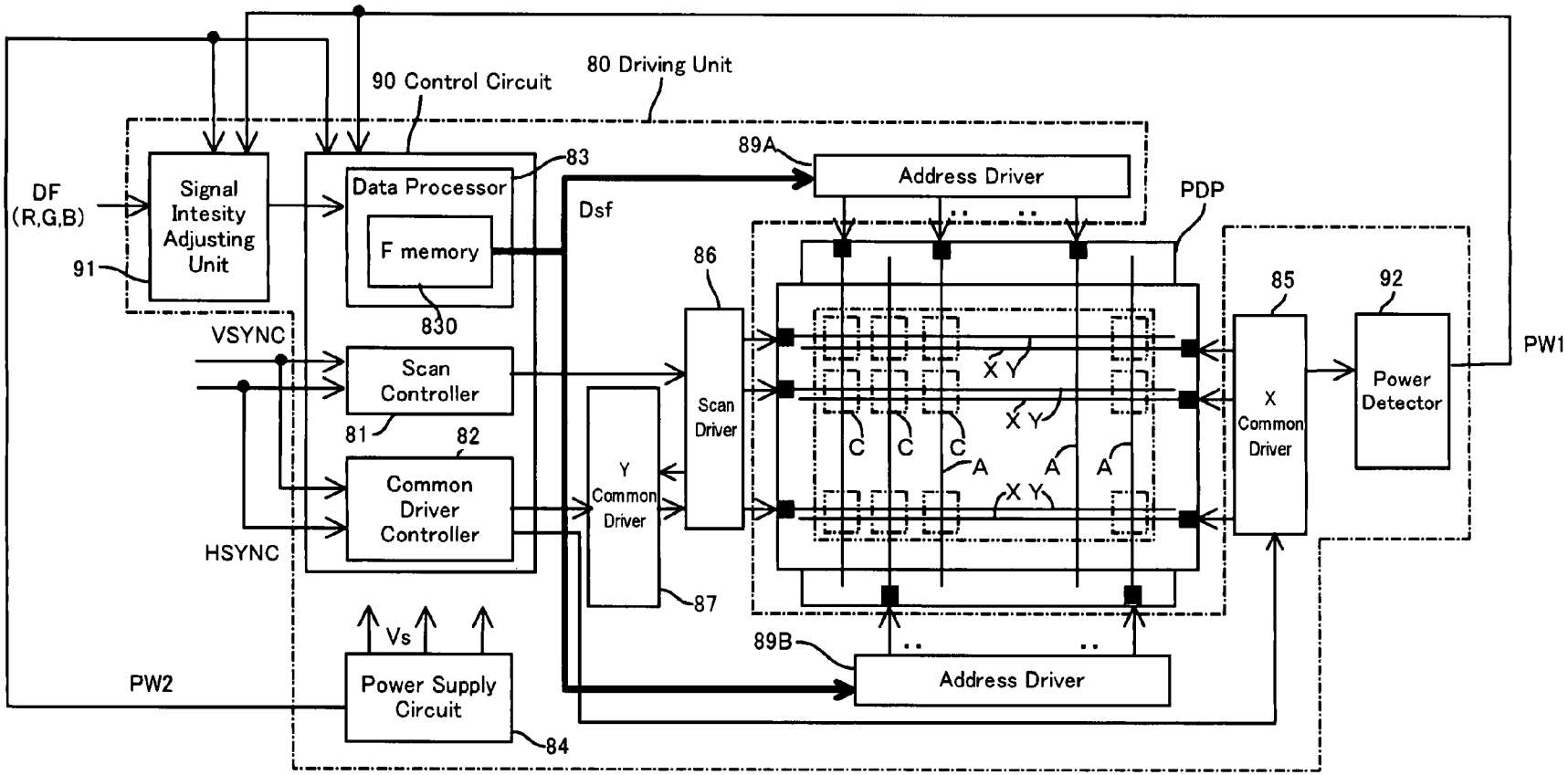
FIG. 8 is a drawing depicting a configuration example of the PDP and the drive unit according to the first embodiment.

FIG. 8 is a drawing depicting a configuration example of the PDP and the drive unit according to the first embodiment. The PDP and the drive unit 80 are connected, for example, by a flexible cable. In FIG. 8, the address electrodes A, X electrodes X, Y electrodes Y and the pixels C are shown in the PDP.

The drive unit 80 comprises address drivers 89A and 89B for driving the address electrodes A, a scan driver 86 for driving the Y electrodes during scanning, an X common driver 85 for commonly driving the X electrodes, and Y common driver 87 for commonly driving the Y electrodes. The image data DF for each frame from the outside includes RGB image data, and is stored in a frame memory 830 in a data processing circuit 83 via a signal intensity adjustment part 91. Synchronization signals $V_{sync}$ and $H_{sync}$ from the outside are supplied to a scan controller 81 and a common driver controller 82 respectively.

The data processing circuit 83, the scan controller 81 for controlling panel driving and the common driver controller 82 constitute the control circuit 90. The data processing circuit 83 executes, for example, gamma conversion and conversion to the sub-field data Dsf based on binary processing for the supplied RGB image data for each frame, and stores the result to the frame memory 830. And, the sub-field data Dsf is supplied to the address drivers 89A and 89B according to the timing signal, which is not illustrated, from the scan controller 81.

The scan controller 81 supplies the timing signal to the scan driver 86 during the address period TA according to the above mentioned synchronization signal to be supplied. The common driver 82 supplies predetermined timing signals to the X and Y common drivers 85 and 87 during the reset period TR and the sustain discharge period TS. The common driver 82 includes a function to control the drive frequency of the sustain discharge pulse during the sustain discharge period so that overall power consumption does not become higher than a predetermined value.

This power consumption can be detected, for example, by the current to be consumed by the power supply circuit 84. The power consumption according to the display load factor can also be detected by the X common driver which supplies a drive pulse with the drive frequency to the X electrodes during the sustain discharge period. In this case, a power detection part 92, illustrated in FIG. 8, detects the power consumption of the X common driver 85.

In the first embodiment, when the power consumption PW1 increases, as shown in FIG. 5, the signal intensity adjustment unit 91 adjusts the intensity of the green image signal included in the image signal to be decreased according to the change of power PW1 in the sustain discharge period detected by the power detection part 92. Or, the signal intensity adjustment unit 91 adjusts the intensity of the blue image signal included in the image signal to be increased.

When the power consumption PW1 decreases, as shown in FIG. 5, the signal intensity adjustment unit 91 adjusts the intensity of the green image signal included in the image signal to be increased. Or, the signal intensity adjustment unit 91 adjusts the intensity of the blue image signal included in the image signal to be decreased.

After the intensity of the green and/or blue image signals are adjusted, the image signals are supplied to the data processing circuit 83. Therefore, the color temperature value and the deviation of white are maintained a roughly at a constant regardless the level of power consumption.

The intensity of green and blue image signals can also be adjusted within the data processing part 83. For example, the intensity of green and blue image signals can be adjusted for correction by increasing or decreasing the output value of the gamma table during gamma conversion. By using the signal intensity adjustment unit 91, a conventional data processing circuit 83 can be used as is.

A green and blue grayscale correction, similar to above, may be executed based on overall power fluctuation detected in the power supply circuit 84.

Figure 9:
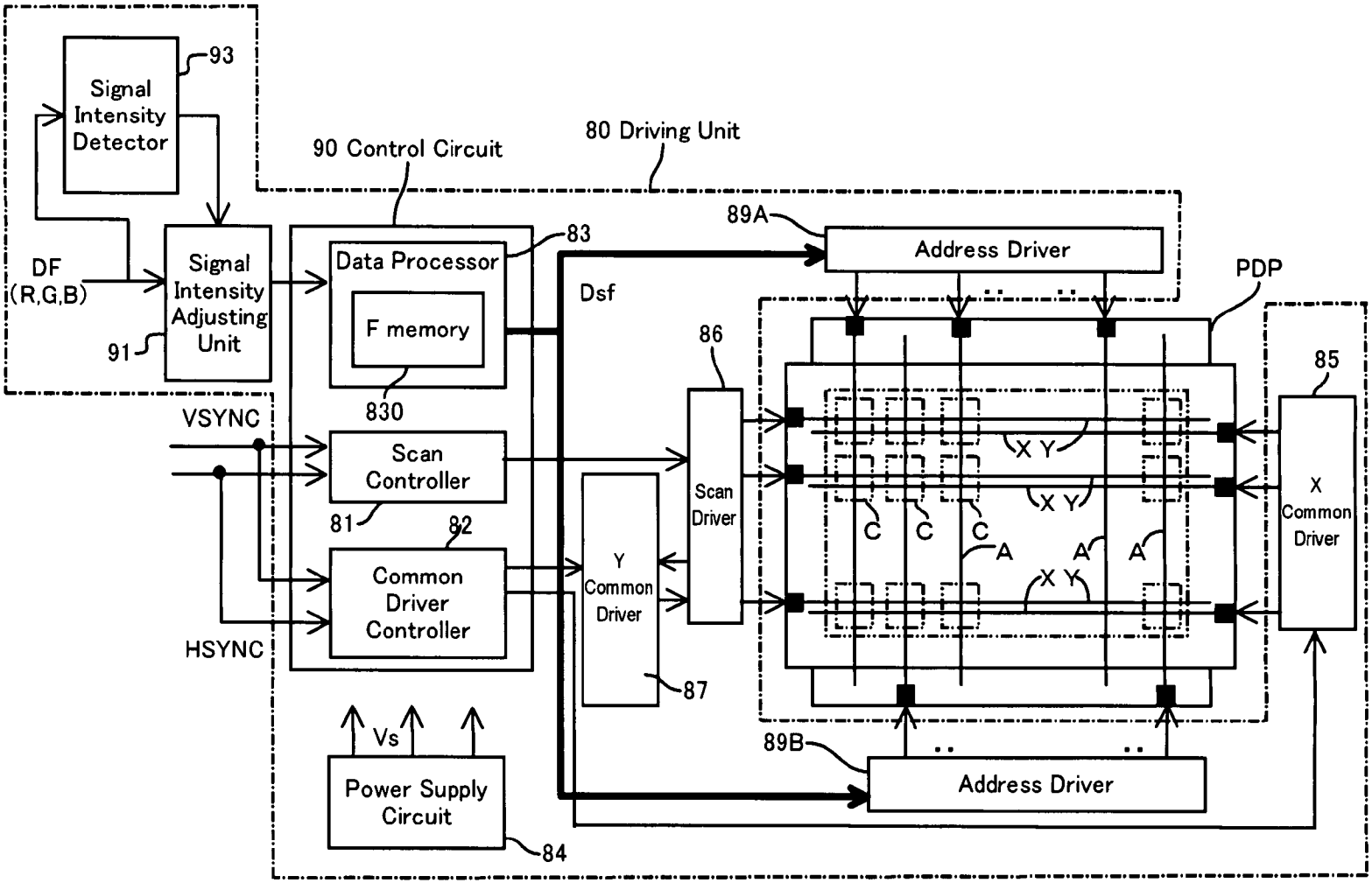
FIG. 9 is a drawing depicting a configuration example of the PDP and the drive unit according to the second embodiment.

FIG. 9 is a drawing depicting a configuration example of the PDP and the drive unit according to the second embodiment. The configuration of the drive unit 80 is almost the same as the first embodiment in FIG. 8. The difference is that the image data DF for each field from the outside is supplied to the signal intensity adjustment unit 91 as well as to the signal intensity detection unit 93. The signal intensity detection unit 93 monitors the intensity of RGB image data, for example, and detects the accumulation of the intensity value for one field. By this, the display load factor of a PDP can be indirectly detected.

The signal intensity information (data) detected by the signal intensity detection unit 93 is supplied to the signal intensity adjustment unit 91. When the detected signal intensity increases, the signal intensity adjustment unit 91 adjusts the intensity of the green image signal included in the image signal to be decreased, as mentioned above. Or, the signal intensity adjustment unit 91 adjusts the intensity of the blue image signal included in the image signal to be increased.

Or, when the detected signal intensity decreases, the signal intensity adjustment unit 91 adjusts the intensity of the green image signal included in the image signal to be increased. Or, the signal intensity adjustment unit 91 adjusts the blue image signal included in the image signal to be decreased.

After the intensity of the green and/or blue image signals is adjusted, the image signals are supplied to the data processing circuit 83. Therefore, the color temperature value and the deviation of white are maintained roughly at a constant regardless the level of power consumption.

Figure 10:
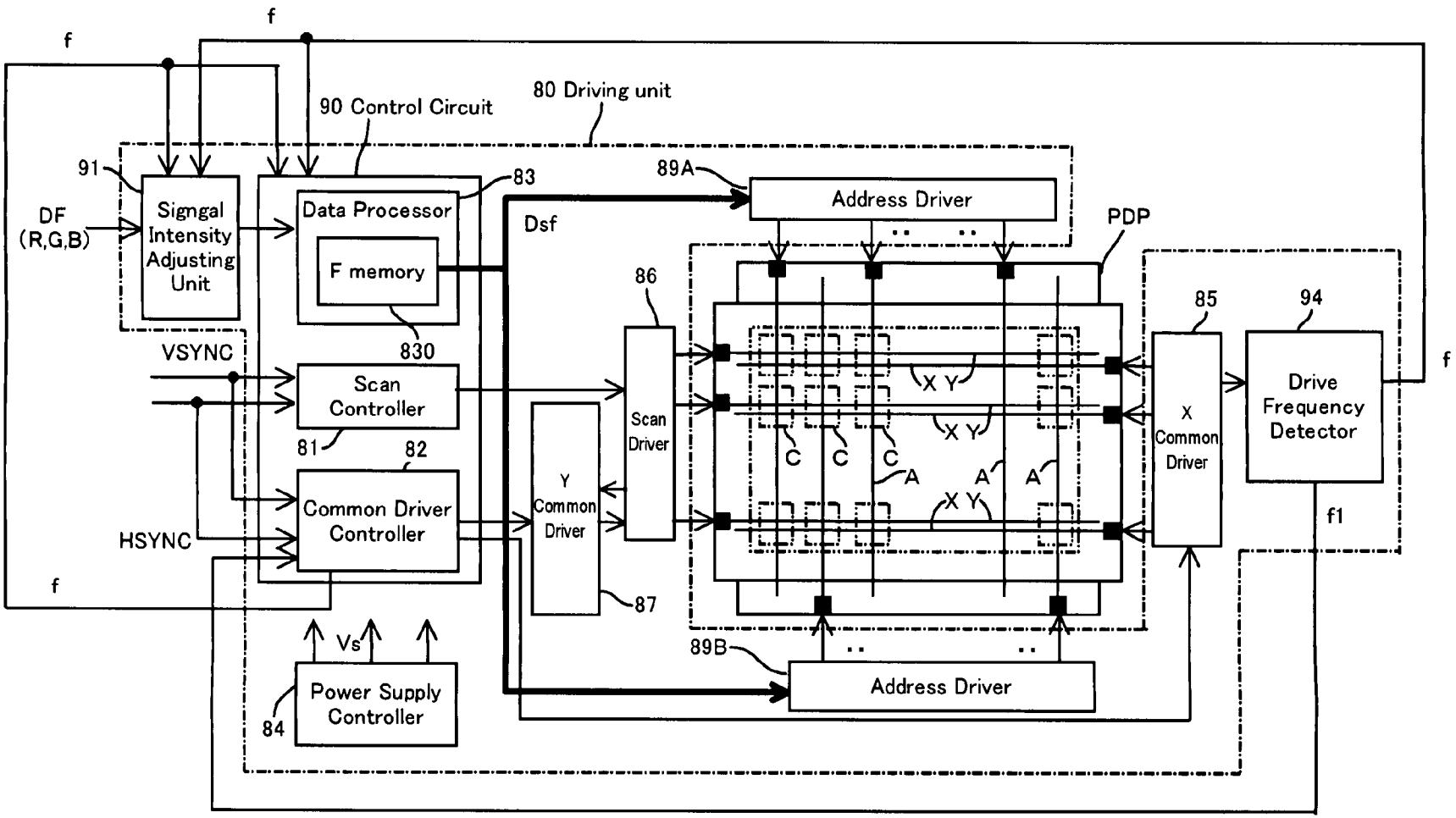
FIG. 10 is a drawing depicting a configuration example of the PDP and the drive unit according to the third embodiment.

FIG. 10 is a drawing depicting a configuration example of the PDP and the drive unit according to the third embodiment. The configuration of the drive unit 80 is almost the same as the first embodiment in FIG. 8. The difference is that the drive frequency detection unit 94 for detecting the drive frequency of the sustain discharge pulse in the sustain discharge period is disposed and the drive frequency f detected by the drive frequency detection unit 94 is supplied to the signal intensity adjustment unit 91 and the data processing circuit 83. The drive frequency detection unit 94 detects, for example, the average of the number of sustain discharge pulses per unit time, and supplies the drive frequency data f to the signal intensity adjustment unit 91.

As FIG. 5 shows, the drive frequency f decreases as the display load factor increases. This is because the common driver controller 82 of the drive unit controls the drive frequency, as shown in FIG. 3, so that the power consumption does not become excessively high. Therefore, by monitoring the drive frequency f, the display load factor can be indirectly monitored. Also, depending on the drive frequency f, the RGB fluorescent substances present the saturation characteristics as shown in FIG. 4.

So, when the drive frequency f decreases, the signal intensity adjustment unit 91 adjusts the intensity of the green image signal included in the image signal to be decreased. Or, the signal intensity adjustment unit 91 adjusts the intensity of the blue image signal included in the image signal to be increased.

Or, when the drive frequency f increases, the signal intensity adjustment unit 91 adjusts the intensity of the green image signal included in the image signal to be increased. Or, the signal intensity adjustment unit 91 adjusts the intensity of the blue image signal included in the image signal to be decreased.

The drive frequency f detected by the drive frequency detection unit 94 may be supplied to the data processing circuit 83. In this case, the luminance of green or blue can be adjusted by adjusting, for example, the output values of the gamma table in the gamma conversion processing in the data processing circuit 83.

The drive frequency f is determined by the common driver controller 82. Therefore, the determined information on the drive frequency f may be supplied to the signal intensity adjustment unit 91 and the data processing circuit 83 to make the above mentioned correction.

The fourth embodiment will now be described. In the fourth embodiment, the drive frequency is monitored so that the drive frequency is limited within the frequency range fL shown in FIG. 4. For this, the drive frequency detection unit 94 shown in FIG. 10 monitors the drive frequency and the detected drive frequency f1 is fed back to the common driver controller 82. The common driver controller 82 controls the drive frequency so that the drive frequency f1 to be detected is maintained within the frequency range fL shown in FIG. 4.

By maintaining the drive frequency in the frequency range fL in this way, RGB fluorescent substances can be excited while avoiding the saturation characteristics. Therefore, the change of color temperature and change of deviation of white depending on the fluctuation of the display load factor can be prevented, and the relative ratio of colors to display an optimum white can be constantly maintained.

In the above embodiment, it is preferable to maintain the color temperature value of white to be displayed at ±200K or less of the set value, and the deviation at set value ±0.005uv or less.

In the above embodiment, if the chromaticity coordinate value of white to be displayed are set at the region of ±0.005uv from the color temperature curve denoted by the black body radiation curve, regardless the value of the display load factor, then a visually preferable white can be displayed because phenomena where white turns color depending on the display load factor does not occur.

In the above embodiment, if the chromaticity coordinate value during a white display is moved such that the color temperature increases and the deviation is maintained as constant as the display load factor increases, then a white with a high color temperature can be displayed, that is, a visually preferable white can be displayed, when the image load factor is high.

In the above embodiment, if the saturation characteristics of the fluorescent substances shown in FIG. 4 differ, the intensity of each color must be adjusted accordingly.

In this way, according to the present invention, the color temperature value of white can be controlled to within a predetermined range depending on the display load factor. Or, the deviation of the color temperature curve of white can be controlled to within a predetermined range. Therefore, an optimum white or a white close thereto can always be displayed and high quality images can be displayed.

The protective scope of the present invention is not restricted by the above embodiments, but the claims and all the variations which come within the meaning of the claims are intended to be embraced therein.

What is claimed is:

1. A plasma display panel which displays colors by exciting a plurality of fluorescent substances of different colors using ultra-violet rays generated during discharges, comprising:

a drive unit which monitors a change of a display load factor of the panel, receives image signals of said different colors and drives areas of different colors in a pixel in the panel according to intensities of the image signals so as to have the areas emit light with emission intensities corresponding to the intensities of the image signals, while controlling to decrease a drive frequency of sustain discharges as the monitored display load factor increases and to increase the drive frequency of sustain discharges as the monitored change in the display load factor decreases, said drive frequency of sustain discharges being in common to said areas of different colors, wherein said drive unit makes a correction to change an intensity of the image signal of a predetermined color, independently of another color, depending on the monitored change of the display load factor, and drives all of the areas in the panel according to the corrected intensity of the one image signal, so that a ratio of the emission intensity of said fluorescent substance of each color during a white display is roughly the same when said display load factor is low and high.

2. A plasma display panel which displays colors by exciting a plurality of fluorescent substances of different colors using ultra-violet rays generated during discharges, comprising:

a drive unit which monitors a change of a display load factor of the panel, receives image signals of said different colors and drives areas of different colors in a pixel in the panel according to intensities of the image signals so as to have the areas emit light with emission intensities corresponding to the intensities of the image signals, while controlling to decrease a drive frequency of sustain discharges as the monitored display load factor increases and to increase the drive frequency of sustain discharges as the monitored change in the display load factor decreases, said drive frequency of sustain discharges being in common to said areas off different colors, wherein when the monitored display load factor increases, said drive unit makes a correction so that an intensity of an image signal of green is decreased or an intensity of an image signal of blue is increased compared with a case when the monitored display load factor is lower, and drives all of the areas in the panel according to the corrected intensity of the image signal of green or blue.

3. A plasma display panel which displays colors by exciting a plurality of fluorescent substances of different colors using ultra-violet rays generated during discharges, comprising:

a drive unit which monitors a change of a display load factor of the panel, receives an image signal of said different colors and drives areas of different colors in a pixel in the panel according to intensities of the image signals so as to have the areas emit light with emission intensities corresponding to the intensities of the image signals, while controlling to decrease a drive frequency of sustain discharges as the monitored display load factor increases and to increase the drive frequency of sustain discharges as the monitored change in the display load factor decreases, said drive frequency of sustain discharges being in common to said areas off different colors, wherein when the monitored display load factor decreases, said drive unit makes a correction so that an intensity of an image signal of green is increased or an intensity of the image signal of blue is decreased compared with a case when the monitored display load factor is higher, and drives all of the areas in the panel according to the corrected intensity of the image signal of green or blue.

4. The plasma display panel according to claim 3, wherein said drive unit monitors a power consumption of the panel as the display load factor and corrects said intensity of the image signal of green or blue on a condition that said display load factor increases when said power consumption increases, and said display load factor decreases when said power consumption decreases.

5. The plasma display panel according to claim 3, wherein said drive unit monitors the drive frequency of the sustain discharges of the panel as the display load factor, and corrects said intensity of the image signal of green or blue on a condition that said display load factor increases when said drive frequency decreases, and said display load factor decreases when said drive frequency increases.

6. The plasma display panel according to claim 3, wherein said drive unit monitors a luminance value and/or a display area value as the display load factor of each color to be supplied per predetermined unit time, and corrects said intensity of the image signal of green or blue on a condition that said display load factor increases when an accumulated total of said luminance value and/or display area value per predetermined unit time is higher, and said display load factor decreases when the accumulated total of said luminance value and/or display area value per predetermined unit time is lower.

7. A plasma display panel which displays colors by exciting a plurality of fluorescent substances of different colors using ultra-violet rays generated during discharges, comprising:

a detector to estimate a display load factor by detecting a change of one of a power consumption of the plasma display panel and a drive frequency of sustain discharges of the plasma display panel; and a drive unit, which receives image signals of said different colors, drives areas of each of the colors in a pixel in the plasma display panel according to intensities of the image signals so as to have the areas emit light with emission intensities corresponding to the intensities of the image signals and changes the drive frequency of sustain discharges according to the estimated display load factor, and changing an intensity of one of the image signals of a predetermined color depending on a change of the estimated display load factor, and driving all of the areas in the panel according to the corrected intensity of the one image signal, so that a ratio of the emission intensity of each of the different colors during a white display is substantially equal regardless of the estimated display load factor.

8. The plasma display panel according to claim 7, wherein the display load factor changes.

9. The plasma display panel according to claim 7, wherein when the display load factor increases from a first level to a second level, higher than the first level, by increasing a luminance and/or a display area of a display image, the drive unit decreases an intensity of an image signal of green light from a first intensity to a second intensity less than the first intensity or increases an intensity of an image signal of blue light from a third intensity to a fourth intensity greater than the third intensity.

10. The plasma display panel according to claim 7, wherein when the display load factor decreases from a first level to a second level, lower than the first level, by decreasing a luminance and/or a display area of a display image, the drive unit increases an intensity of an image signal of green light from a first intensity to a second intensity greater than the first intensity or decreases an intensity of an image signal of blue light from a third intensity to a fourth intensity less than the third intensity.

11. The plasma display panel according to claim 9, wherein said drive unit detects the power consumption of the plasma display panel as the display load factor and adjusts the intensity of the image signal of the green light and/or the intensity of the image signal of the blue light based on a relationship between display load factor changes and power consumption changes.

12. The plasma display panel according to claim 10, wherein said drive unit detects the power consumption of the plasma display panel as the display load factor and adjusts the intensity of the image signal of the green light and/or the intensity of the image signal of the blue light based on a relationship between display load factor changes and power consumption changes.

13. The plasma display panel according to claim 9, wherein said drive unit detects the drive frequency of the sustain discharges of the plasma display panel and adjusts the intensity of the image signal of the green light and/or the intensity of the image signal of the blue light based on a relationship between display load factor changes and drive frequency changes.

14. The plasma display panel according to claim 10, wherein said drive unit detects the drive frequency of the sustain discharges of the plasma display panel and adjusts the intensity of the image signal of the green light and/or the intensity of the image signal of the blue light based on a relationship between display load factor changes and drive frequency changes.

15. The plasma display panel according to claim 9, wherein said drive unit detects a luminance value and/or a display area value of each color to be supplied per predetermined unit time, and adjusts the intensity of the image signal of the green light or the intensity of the image signal of the blue light based on a relationship between changes of the display load factors and changes of an accumulated total of an luminance value and/or a display area value per predetermined unit time.

16. The plasma display panel according to claim 10, wherein said drive unit detects a luminance value and/or a display area value of each color to be supplied per predetermined unit time, and adjusts the intensity of the image signal of the green light or the intensity of the image signal of the blue light based on a relationship between changes of the display load factor and changes of an accumulated total of an luminance value and/or a display area value per predetermined unit time.

* * * * *

UNITED STATES PATENT AND TRADEMARK OFFICE

CERTIFICATE OF CORRECTION

PATENT NO. : 7,126,562 B1
APPLICATION NO. : 09/593424
DATED : October 24, 2006
INVENTOR(S) : Katsuya Irie et al.

It is certified that error appears in the above-identified patent and that said Letters Patent is hereby corrected as shown below:

Column 9, Line 61, change “off” to --of--.

Column 10, Line 18, change “off” to --of--.

Signed and Sealed this

Twelfth Day of June, 2007

JON W. DUDAS
*Director of the United States Patent and Trademark Office*